US006631527B2

(12) United States Patent
Hyduk

(10) Patent No.: US 6,631,527 B2
(45) Date of Patent: Oct. 14, 2003

(54) KIT OF BEACH PRODUCTS

(76) Inventor: Michael A. Hyduk, 37 Aster Ct., Belle Mead, NJ (US) 08502

( * ) Notice: Subject to any disclaimer, the term of this patent is extended or adjusted under 35 U.S.C. 154(b) by 0 days.

(21) Appl. No.: 10/171,975

(22) Filed: Jun. 17, 2002

(65) Prior Publication Data

US 2003/0019034 A1 Jan. 30, 2003

Related U.S. Application Data

(60) Provisional application No. 60/296,776, filed on Sep. 10, 2001, provisional application No. 60/296,777, filed on Sep. 7, 2001, provisional application No. 60/296,778, filed on Sep. 10, 2001, provisional application No. 60/296,779, filed on Jun. 8, 2001, provisional application No. 60/296,780, filed on Jul. 26, 2001, and provisional application No. 60/306,244, filed on Aug. 10, 2001.

(51) Int. Cl.[7] ..... A47G 9/06

(52) U.S. Cl. ..... 5/417; 5/656; 135/118

(58) Field of Search ..... 5/417, 418, 419, 5/420, 656; 135/118

(56) References Cited

U.S. PATENT DOCUMENTS

| | | | | | |
|---|---|---|---|---|---|
| 2,840,092 | A | * | 6/1958 | Hill | 135/118 |
| 2,899,153 | A | * | 8/1959 | Parker | 248/694 |
| 2,907,057 | A | * | 10/1959 | Sprecht | 5/417 |
| 3,241,202 | A | * | 3/1966 | Knauft | 24/327 |
| 3,935,653 | A | * | 2/1976 | Klein | 40/606 |
| 4,334,661 | A | * | 6/1982 | Pitt | 248/146 |
| 5,081,727 | A | | 1/1992 | Ippolito | |
| D325,678 | S | | 4/1992 | Niles | |
| 5,141,200 | A | | 8/1992 | Sherman et al. | |
| 5,245,715 | A | | 9/1993 | Dinkins | |
| 5,294,083 | A | | 3/1994 | Roth | |
| 5,452,877 | A | | 9/1995 | Riffle et al. | |
| 5,520,364 | A | | 5/1996 | Bloxson et al. | |
| 5,524,309 | A | | 6/1996 | La Barbera | |
| 5,666,678 | A | | 9/1997 | Wall | |
| 5,713,383 | A | | 2/1998 | Ramirez et al. | |
| 6,093,069 | A | | 7/2000 | Schelfhout | |
| 6,226,813 | B1 | | 5/2001 | Wilburn et al. | |
| 2002/0084197 | A1 | * | 7/2002 | Carbonneau | |

* cited by examiner

*Primary Examiner*—Michael F. Trettel

(57) ABSTRACT

A kit of various beach products consisting of a ground covering such as a blanket, spread, mat or towel and the like with a plurality of loops or buttonholes at multiple locations on the top and bottom of the hem which can be optionally rolled into a sheath for storage and transport of ground anchors; a plurality of direct attachment ground anchor pins or tethered ground anchor assemblies which are used to secure the covering to the ground or sand; which tethered ground anchors also incorporate a capped cup holder, a flag or a fastener. A compact kit of such products are useful for the convenience, enjoyment and safety of a person at the beach, pool or patio.

10 Claims, 13 Drawing Sheets

KIT OF BEACH PRODUCTS

CROSS REFERENCE TO RELATED APPLICATIONS

This application claims the benefit of the following U.S. Provisional Applications: 60/296,776 filed Sep. 10, 2001; 60/296,777 filed Sep. 7, 2001; 60/296,778 filed Sep. 10, 2001; 60/296,779 filed Jun. 8, 2001; 60/296,780 filed Jul. 26, 2001; and 60/306,244 filed Aug. 10, 2001.

The present invention relates to a kit of various beach products consisting of a ground covering such as a beach towel and having secured thereto, ground anchor pins or tethered ground anchor assemblies and selectively the anchor assemblies may include a cup holder, a flag or a fastener.

BACKGROUND OF INVENTION

1. Field of the Invention

The invention relates to a kit of various beach products associated with a ground covering. As defined in this application, the term "ground covering" refers to a ground covering, a ground cover, a beach towel, a blanket, a spread, a mat, and other such similar items. The ground covering, as shown in FIG. 1, has a rectangular shape.

2. Description of the Related Art

A ground cover, such as a blanket, a spread, a mat, a towel or such other similar items, that is placed on the sandy beach tends to reposition itself when the wind blows and/or other movements occur. Once positioned, this covering is readily subject to disarray from these movement effects. This results in reduced usage area of a covering as well as discomfort to the user. Throughout the years, a number of innovations have been developed relating to solving these challenges. The following patents are considered representative of some of these innovations. For illustrative purposes only, the cited patents have been separated to refer to the various features of the invention; however, patents directed to one feature may be pertinent to others.

The prior art directed to a first feature of the kit of beach products, namely, loops or reinforced buttonholes being constructed on appropriate positions on the hem or hems of the ground covering, includes the following patents:

U.S. Pat. No. 5,141,200 to Sherman et al. discloses a spike through a grommet on a tab that is attached to a pocket for receiving sand as a weight. A strap is provided to receive the corner of a towel which is inserted into a pocket.

U.S. Pat. No. 6,226,813 to Wilburn et al. discloses a circular grommet for the insertion of the closed loop that is connected to a pin.

The prior art directed to a second feature of the kit of beach products, namely, wherein there is included a plurality of ground anchor pins for retaining a ground covering on the sand, includes the following patents:

U.S. Pat. No. 5,666,678 to Wall relates to a ground covering having various means of attachment to weights with optional spikes. A case which utilizes a strap for transport about the users waist also serves as a weight that can be divided into two parts. The weights can be attached to the ground covering with Velcro™ or clamps.

The prior art directed to a third feature of the kit of beach products, namely, substituting ground anchor assemblies for the ground anchor pins recited in the first feature, each of the anchor assemblies having a tether for securing the anchor assemblies to the ground covering, includes the following patents:

U.S. Pat. No. 5,081,727 to Ippolito describes combination beach towels and carrying cases and suggests carrying anchoring stakes in its rolled up towel secured by elastic straps.

U.S. Pat. No. 5,245,715 to Dinkins is directed to a blanket anchor apparatus. The apparatus has an anchor and tethered clip but the single strand tether has loops at either end. The tether is fastened to the anchor at the head which is flat. The anchor has ridges to hold the anchor more securely in the sand. The practical utility of these ridges is questionable for two reasons: the top few inches of sand are too loose for the ridges to hold, and if the wind is blowing so hard as to make the ridges necessary, perhaps the safest place is not on the beach. An anchor is held in place by driving the tip of the anchor an inch or so into the firm subsurface. The clip appears to be a custom alligator-style design and probably expensive to make. The area of the clip in contact with the blanket appears to be needlessly large giving the impression that the designer intended the size of the clip to be more important than its gripping mechanism or force. This patent shows a single-strand tether connecting to the anchor and both use an alligator-style clip.

U.S. Pat. No. 5,520,364 to Bloxson et al. is a clothes-pin style clip attached with a looped strap to a weighted pocket. Such devices require the user to carry multiple weighted sack to and from the beach.

The prior art directed to a fourth feature of the kit of beach products, namely, at least one of the ground anchor assemblies being associated with a cup holder and the ground covering, includes the following patents:

U.S. Pat. No. 5,294,083 to Roth uses a pressure plate to hold down the blanket which is a less effective means of securing the blanket and quite similar to placing a shoe or cooler on the corners. The product will probably serve as a drink-holder anchored into the sand, but not as a secure anchor for a towel or blanket in all situations.

Design Patent 325,678 to Niles is a stake with a drink-holder passed through the opening in the blanket and firmly fixing the blanket to the sand. It does not use a tether nor a foot pedal.

The prior art of a fifth feature of the kit of beach products, namely, at least one of ground anchor assemblies associated with a flag and the ground covering, includes the following patents:

U.S. Pat. No. 5,452,877 to Riffle et al. described a bag filled with sand to support a beach umbrella.

U.S. Pat. No. 6,093,069 to Schelfhout describes a buoy system that utilizes tether lines to stabilize a flag attached to a flotation unit.

The prior art directed to a sixth feature of the kit of beach products, namely, a plurality of clip fasteners associated with the ground covering for attaching the anchor assemblies to the ground covering, includes the following patents:

U.S. Pat. No. 5,524,309 to La Barbera and U.S. Pat. No. 5,713,383 to Ramirez et al., cite integral anchors and alligator-style clips. Such devices are inferior to tethered anchors. Fixing the blanket to the sand places considerable stress on the anchoring site as weight (most often over 100 pounds) is placed on the blanket and will eventually result in weakening of the fabric (if the gripping force is too great) or separating the clip from the blanket (if the gripping force is too weak). The gripping force of the clip must withstand the combined effects of use and wind gusts.

None of the above inventions and patents, taken singly or in combination, are seen to describe the instant invention as claimed.

SUMMARY OF THE INVENTION

A principle object of the present invention relates to a kit of various beach products consisting of a ground covering such as a beach towel with loops or buttonholes and having secured thereto, ground anchor pins or tethered ground anchor assemblies and selectively the anchor assemblies may include a cup holder, a flag or a fastener.

More specifically, the object of the present invention relates to a kit consisting of a ground covering such as a beach towel having loops or buttonholes and hems rolled into sheaths, anchor pins being secured to the ground covering, which pins penetrate into the ground or a sandy beach. Or in lieu of the anchor pins, tethered anchor assemblies are used which selectively may include a capped cup holder, a flag or a fastener. A compact kit of such products is useful for the convenience, enjoyment and safety of a person at the beach, pool or patio.

DETAILED DESCRIPTION OF THE INVENTION

The invention relates to a kit of various beach products associated with a ground covering. As defined in this application, the term "ground covering" refers to a ground covering, a ground cover, a beach towel, a blanket, a spread, a mat, and other such similar items.

Figure 1:
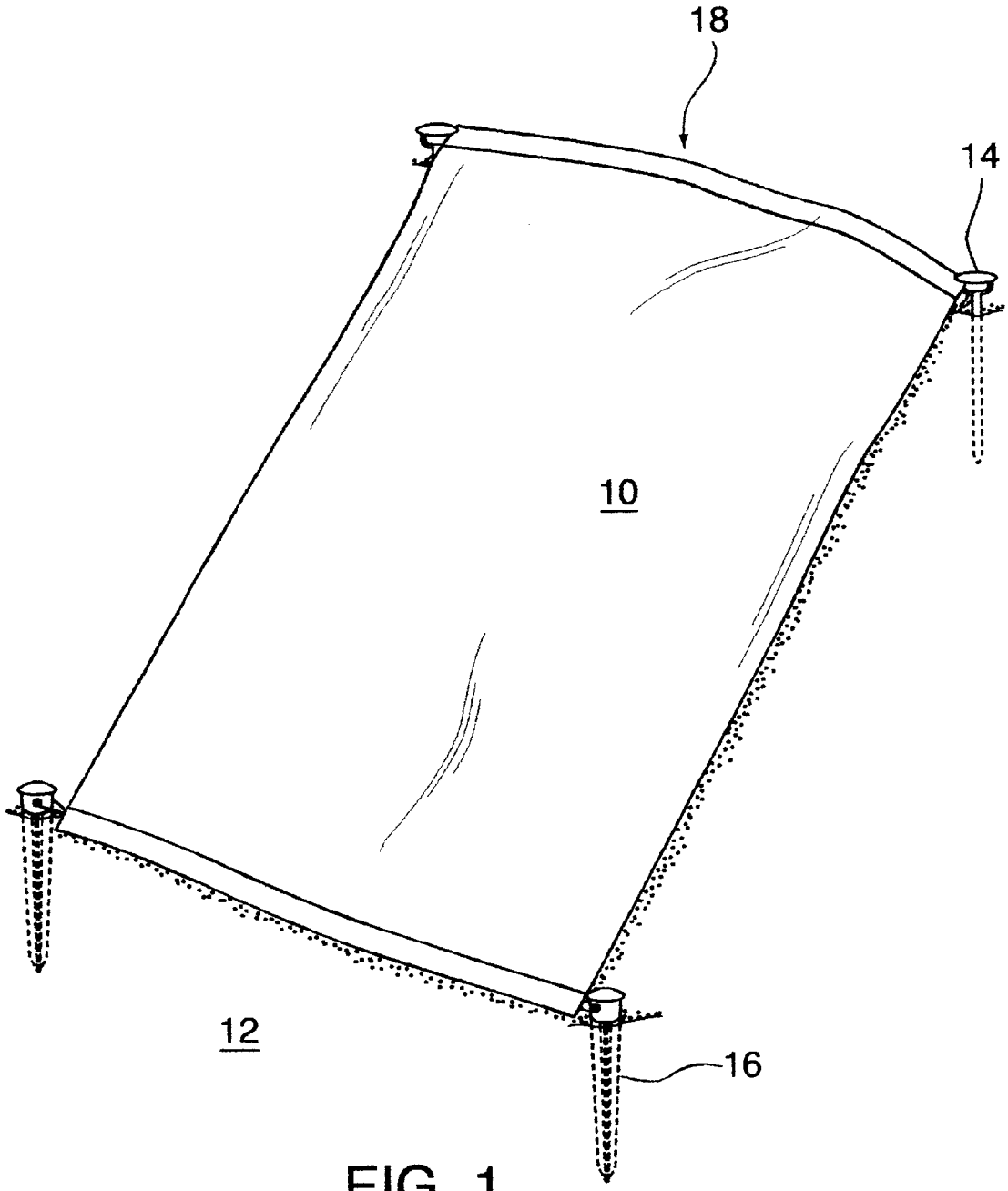
FIG. 1 is a perspective view of the ground covering showing anchor pins at the top and anchor assemblies at the bottom thereof, in accordance with the present invention.

FIG. 1 shows two ground anchor pins 14 secured at the corners of the top of the ground covering 10. Two ground anchor assemblies or spikes 16 are secured at the bottom thereof. A substitution of the ground anchor assemblies 16 may be made for the ground anchor pins 14 and vice versa.

Figure 2A:
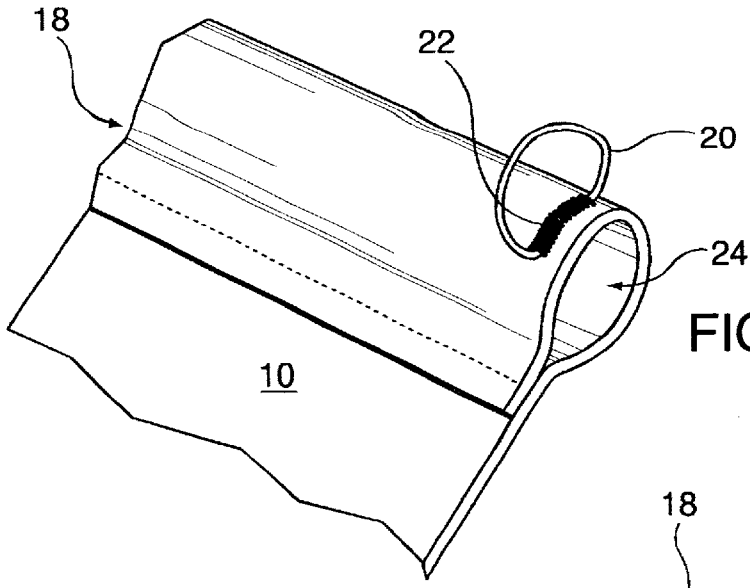
FIGS. 2A, 2B and 2C are partial perspective views of the ground covering, showing three forms of attaching the loop to the ground covering.
Figure 2B:
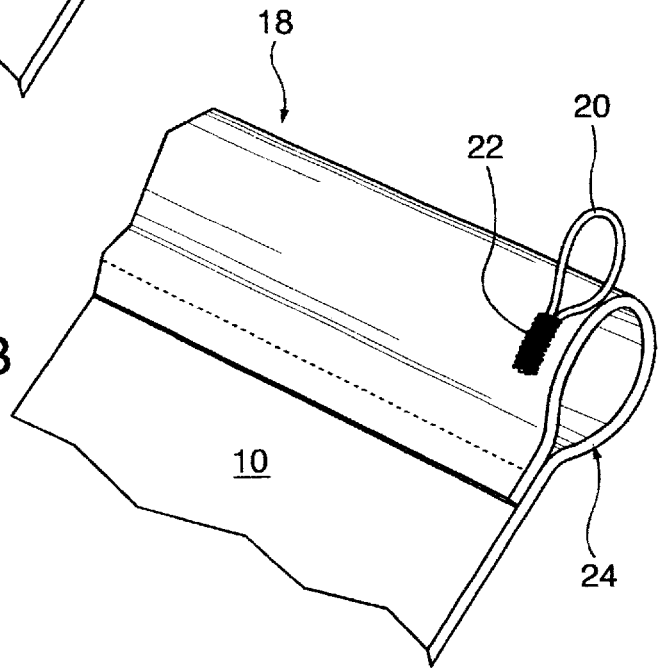
Figure 2C:
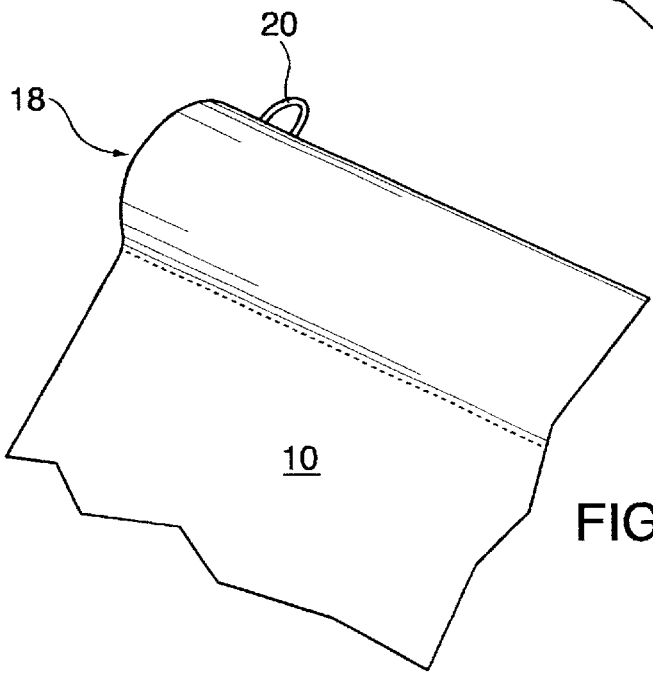

FIGS. 2A, 2B and 2C show three forms of attaching loops 20 to the ground covering. FIG. 2A shows the loop 20 in the form of a circle whose one side is stitched to the underside of a hem 18 which is rolled over and stitched to the covering 10 forming a sheath 24. The reinforced hems 18 are formed at each end of the ground covering 10. FIG. 2B is similar to FIG. 2A and shows the loop 20 in the form of a teardrop whose narrow end is stitched to the underside of the hem 18 forming the sheath 24. FIG. 2C is similar to FIG. 2A and shows the loop 20 in either a circle or teardrop configuration stitched to the underside of the hem 18 without the formation of a sheath.

Figure 3A:
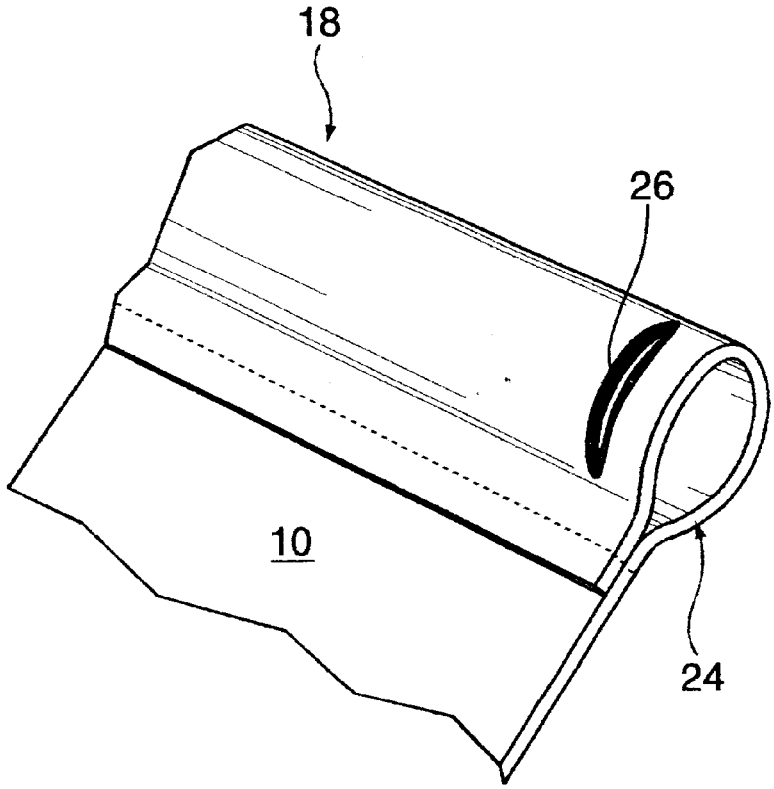
FIGS. 3A and 3B are partial perspective views of the ground covering, showing the buttonhole thereon.
Figure 3B:
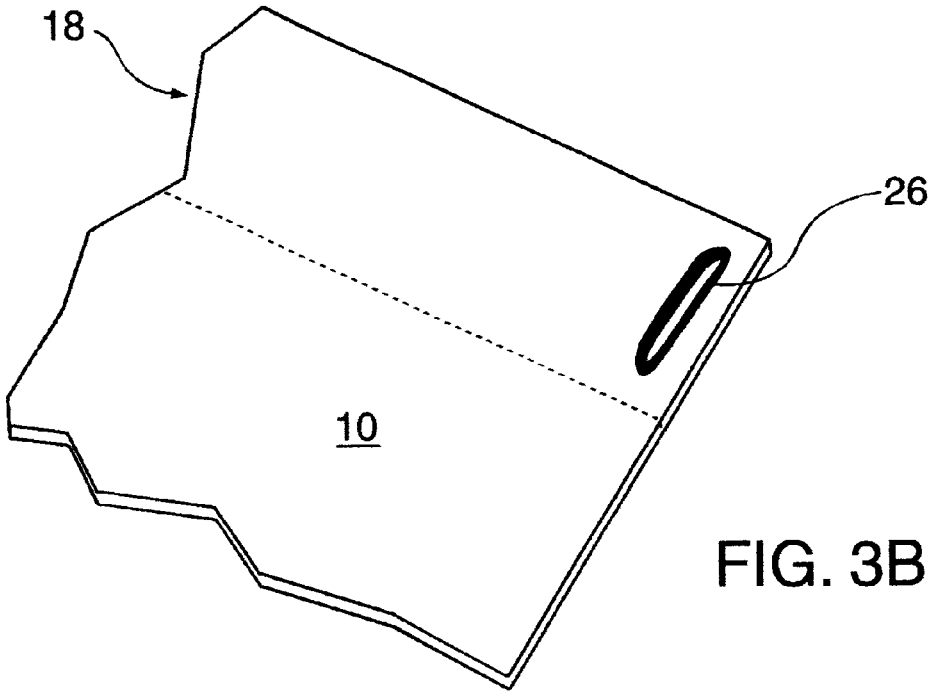

FIG. 3A shows a reinforced buttonhole 26 on the underside of the hem 18 which is rolled over and stitched to the covering 10 to form the sheath 24. FIG. 3B shows the buttonhole 26 in the hem without the formation of the sheath.

The loops and the buttonholes 26 are constructed on appropriate positions on the hems 18. The loop 20 is stitched securely to the top surface of the covering 10. The hem 18 is then folded or rolled over and stitched to the covering 10 so that the end result is the loop 20 is positioned on the underside of the covering 10. In a similar fashion, the buttonholes 26 are placed into the top of the hem 18 and the hem 18 is folded or rolled over to position the buttonholes 26 on the underside of the covering 10.

Figure 4:
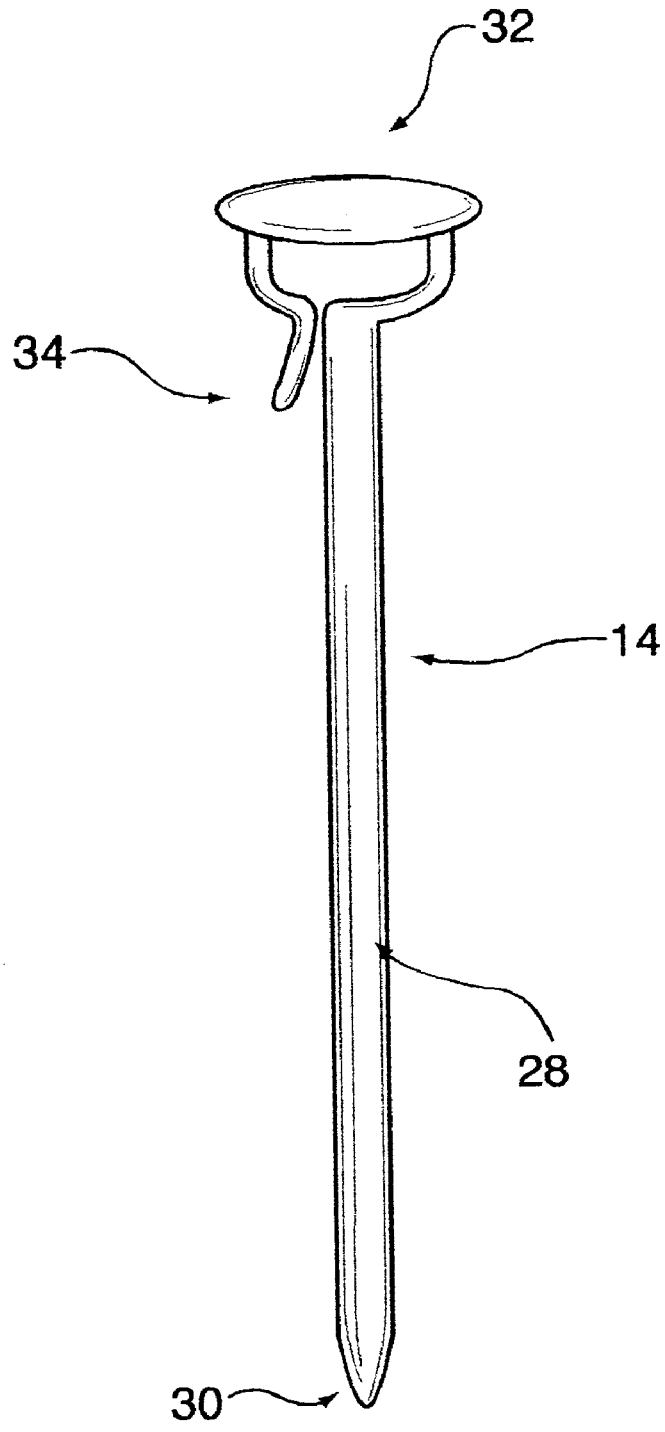
FIG. 4 is a perspective view of the ground anchor pin.

FIG. 4 shows the structural arrangement of the anchor pin 14. In FIG. 1, two pins 14 are shown secured to the top corners of the ground covering 10, but more anchor pins could be used if found necessary. Each pin 14 consists of a head 32, a tension clip 34 under the head 32 and a shaft 28 terminating in a pointed end 30. The tension clip 34 is firmly affixed to the head 32. The head 32 is rounded to facilitate the driving of the pin 14 into the sand 12 by the user pressing with the heel of the hand, the foot or a suitable tool such as a mallet. The anchor pin and the tension clip may be made in any suitable length. The anchor pin may be used in any application where a ground covering has a provision for attachment such as a loop, tab, grommet, eyelet and the like.

Figure 5:
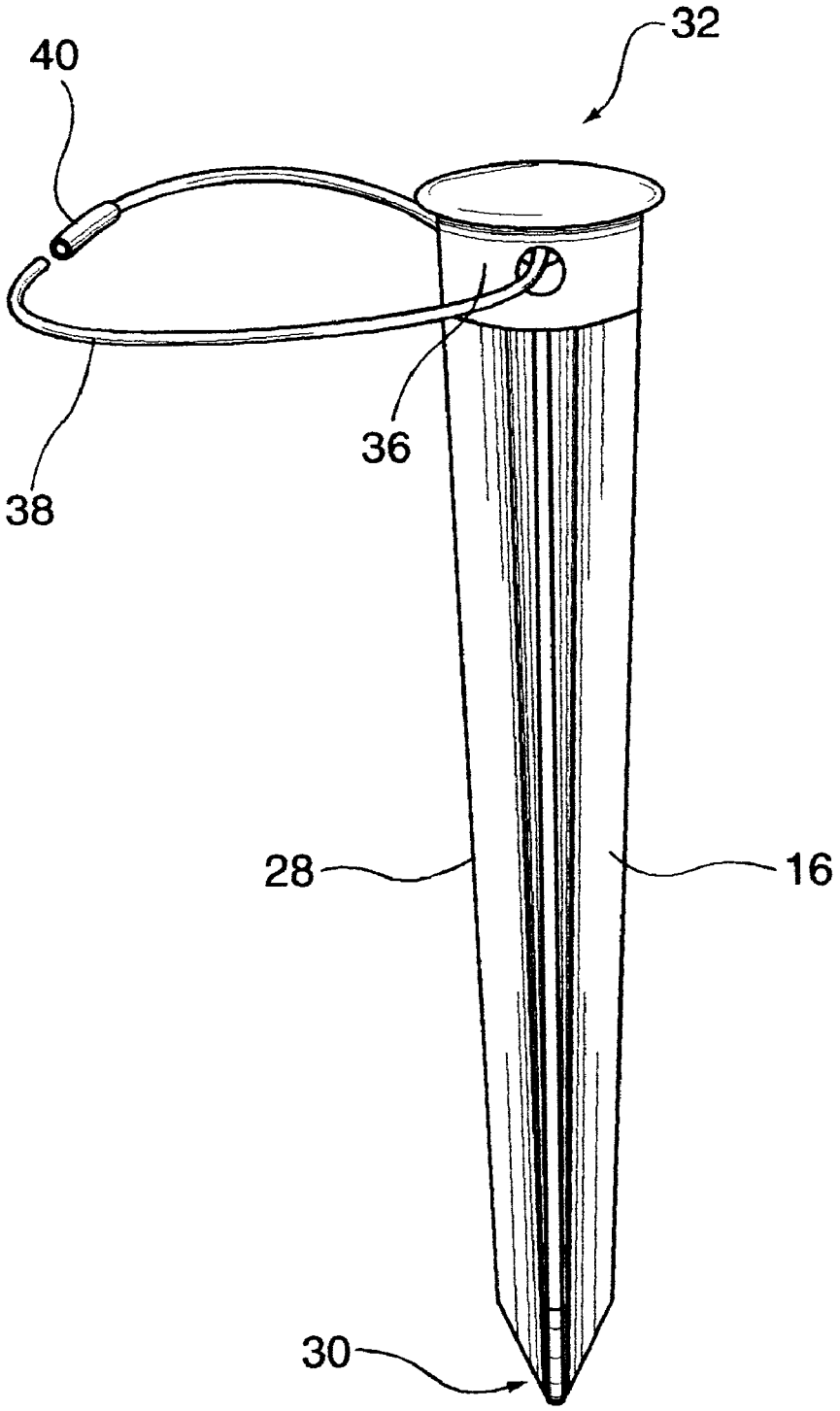
FIG. 5 is a perspective view of the ground anchor assembly, showing the connecting tether and the end-to-end connector.
Figure 6:
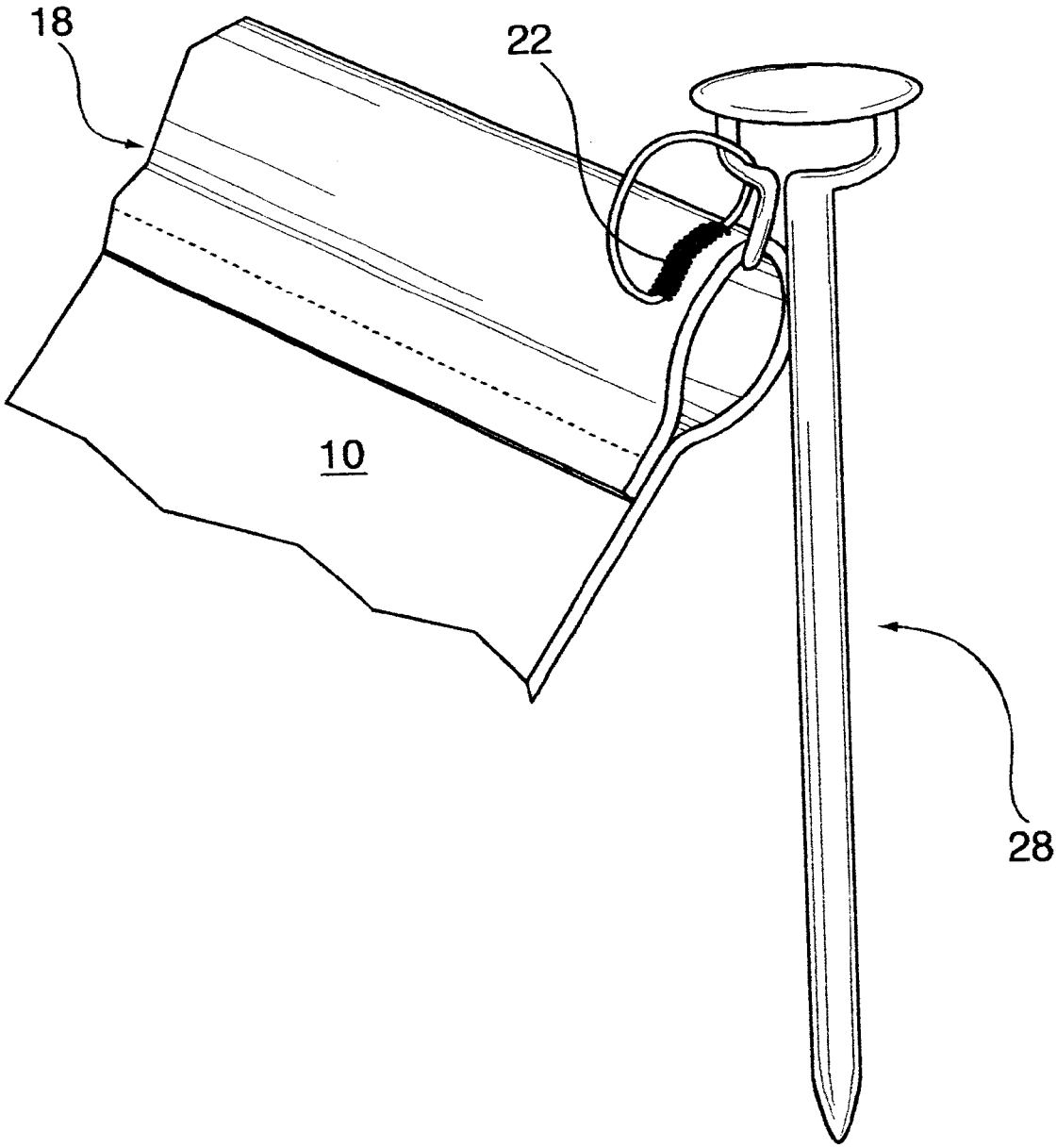
FIG. 6 is a partial perspective view of the ground covering, showing the anchor pin and the connecting loop.

FIG. 5 shows the ground anchor assembly 16 having the tether 38 with its end-to-end connector 40. The tether 38 passes through aperture 36 of the anchor assembly 16. FIG. 6 shows the ground covering 10 having the loop 20 on the underside of the hem 18 which is rolled over to form the sheath 24 and the anchor pin 14 is attached to the loop 20.

Figure 7:
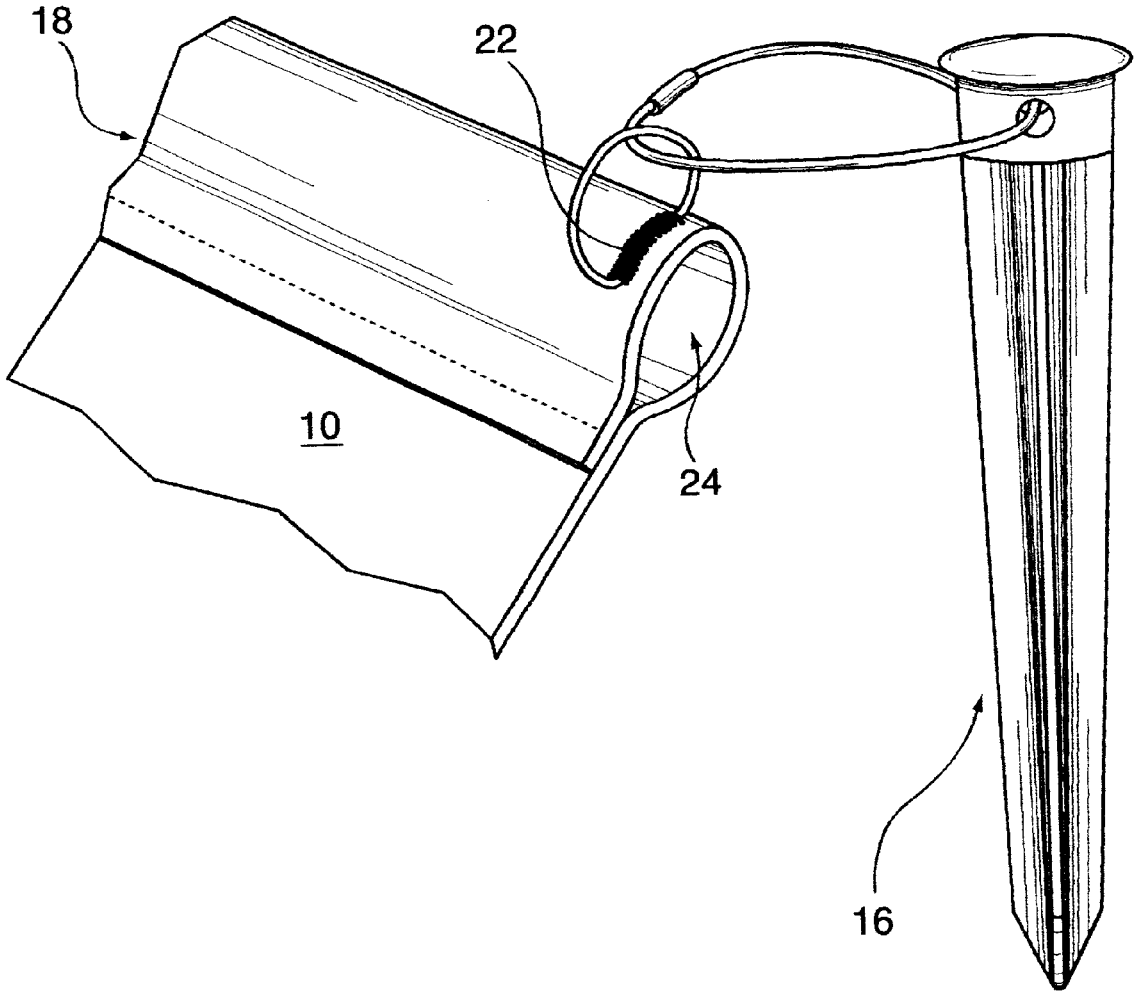
FIG. 7 is a partial perspective view of the ground covering with the connecting tether and the loop.
Figure 8:
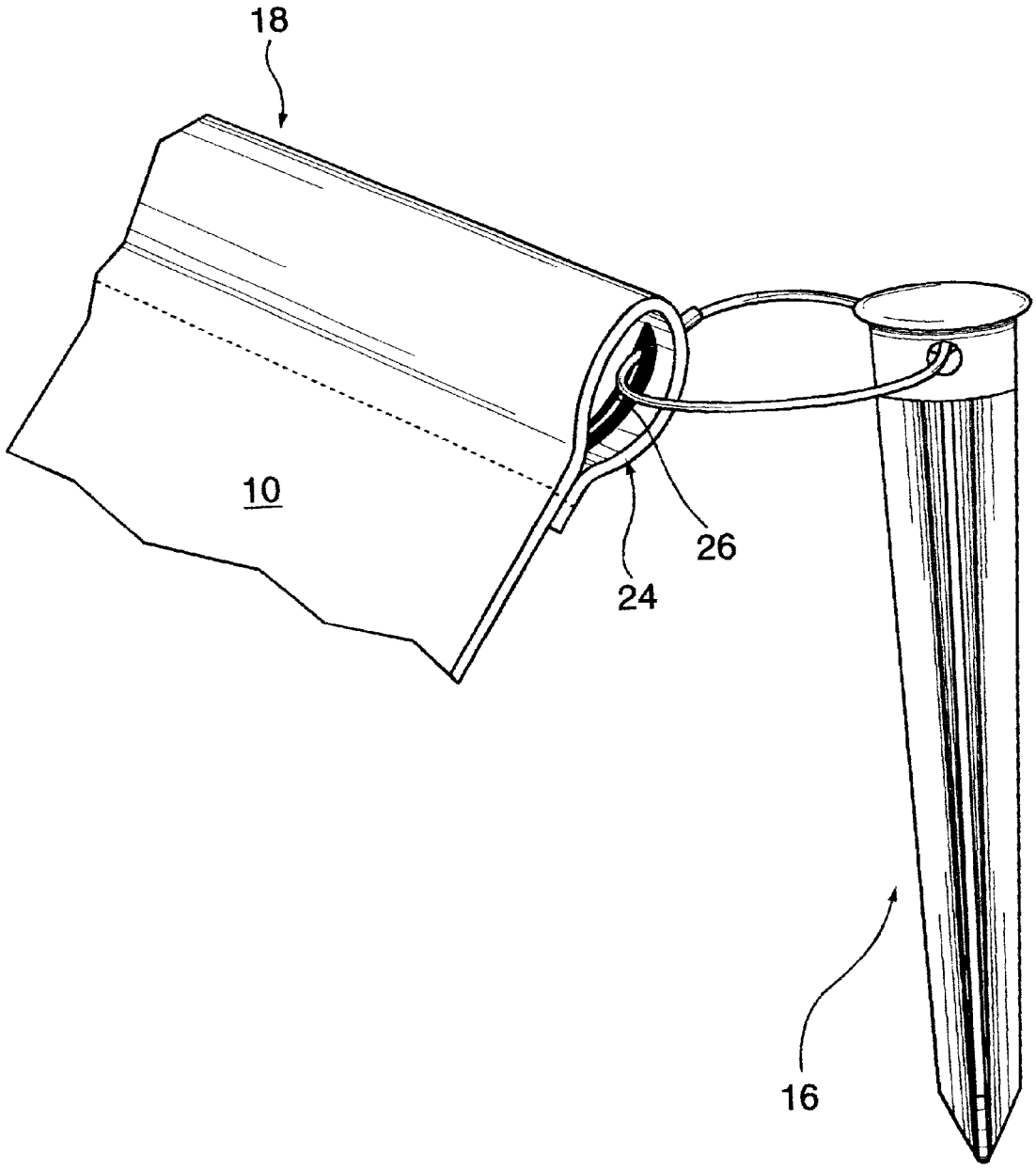
FIG. 8 is a partial perspective view of the ground covering with the loop passing through the buttonhole.

FIG. 7 is similar to FIG. 6 and shows the ground covering 10 having the loop 20 on the underside of the hem 18 which is rolled over to form the sheath 24 and the anchor assembly 16 is attached to the loop 20 and the connecting tether 38. FIG. 8 is similar to FIGS. 6 and 7 and shows the ground covering 10 having the loop 20 on the underside of the hem 18 which is rolled over to form the sheath 24 and the anchor assembly 16 is attached to the tether 38 which passes through the buttonhole 26 on the underside of the hem 18.

Placement of a loop or buttonhole may be constructed on the underside of a ground covering and as such would have the advantage of leaving the top surface of the ground covering more attractive. Also, the attachment site of an anchor assembly could be selected to be substantially out of view and thus would not interfere with the activities of the user. A loop or buttonhole may be constructed on a ground covering to be visible from the top or be placed out of sight. Loops or buttonholes may be positioned at any suitable location on a ground covering. Loops and buttonholes may be in various shapes, sizes, or arrangements, such as being constructed to be parallel to the ends or to the sides of a ground covering. The ground covering may also be made without a sheath in which case the loops can still be positioned on the underside whereas the buttonholes would be through the covering and therefore visible when viewed from above.

Figure 9:
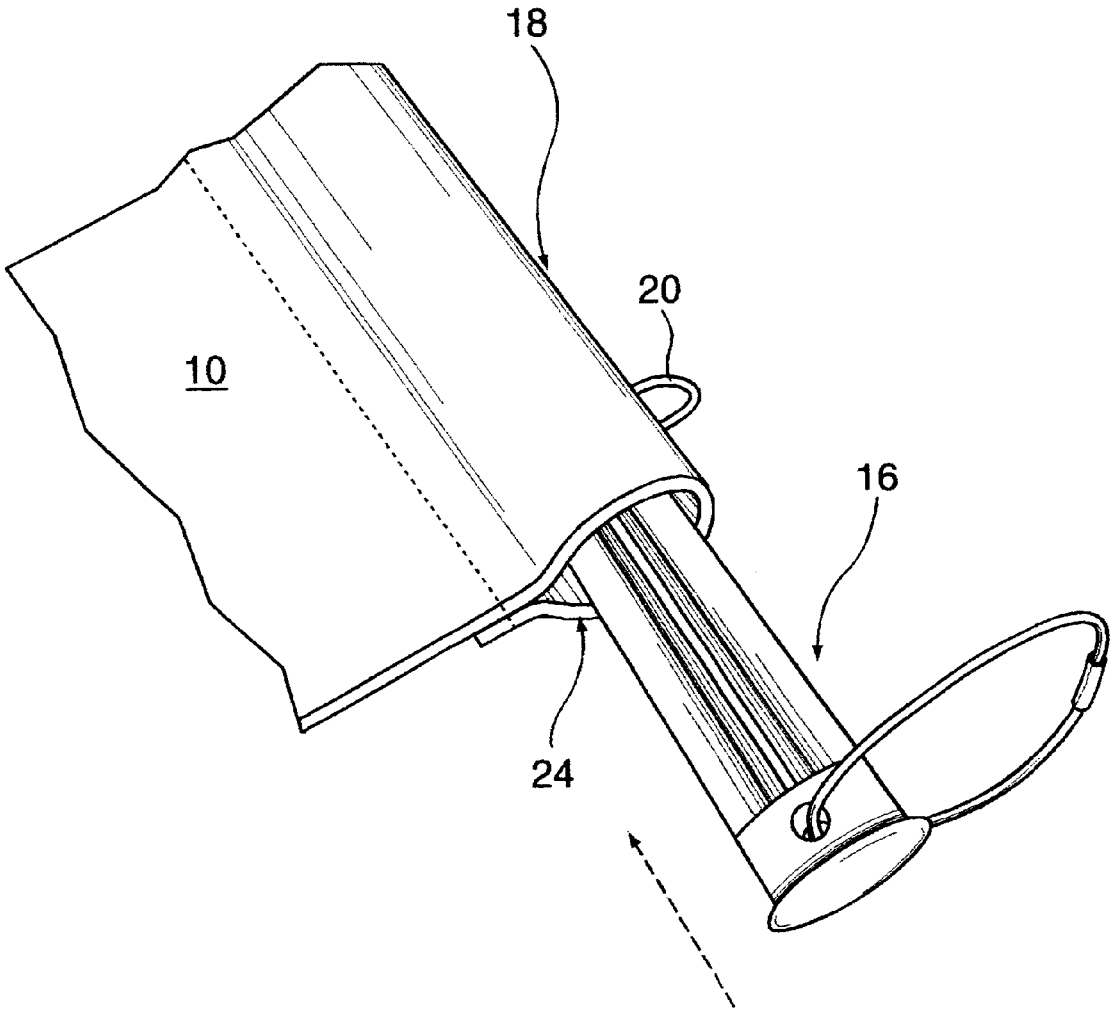
FIG. 9 is a partial perspective view of an anchor assembly being inserted for storage within a sheath of the ground covering.

FIG. 9 shows the anchor assembly 16 being inserted for storage within the sheath 24 on one end of the covering 10. This storing feature may also be utilized on the hem of the other end of the covering 10. Each anchor assembly 16 comprises a shaft 28 having a cap 52 and a pass-through-aperture 36 near the top of the shaft 28 for insertion of the flexible tether 38 that connects with the hem 18. Thus, anchor assembly 16 is operatively connected to the ground covering 10. The cap 52 is rounded to facilitate the user's driving of the anchor assembly 16 into the sand 12 with the hand, foot or a suitable tool such as a mallet. A tether may consist of a flexible closed loop with an end-to-end connection and be made of any suitable material and length. The length of the tether must be such that an anchor assembly is not too far from a ground covering itself to avoid interference with other people nearby or passing by. In the present invention, the reinforced hems 18 at each end of the ground covering 10 are rolled into cylindrical shape members or sheaths 24 wherein parts of the kit may be stored therein, and thereby facilitating transport.

The anchor assemblies may be used in any application where a ground covering has a provision for attachment such as a loop, tab, grommet, eyelet and the like.

Figure 10:
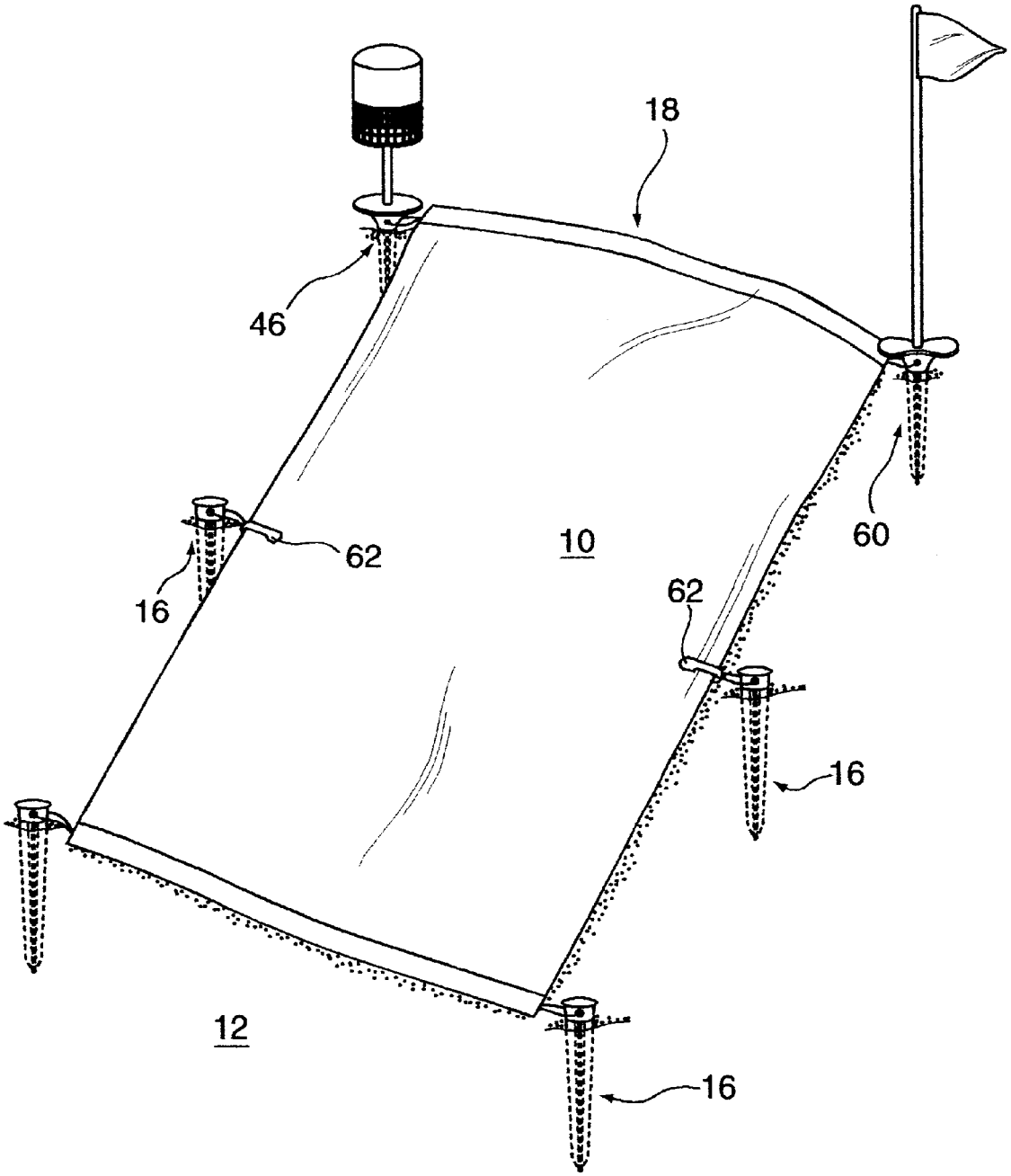
FIG. 10 is a perspective view of the ground covering showing anchor assemblies holding the cup holder, the flag and the clip fastener.

FIG. 10 shows a capped beverage cup holder 46, a flag or pennant 60 and a clip fastener 62 mounted on anchor assemblies 16. This is one possible arrangement of the cup holder, flag, anchor assembly and clip fastener but any number, combination, placement and arrangement of these items are possible depending on the provisions in the ground covering and the preferences of the user.

Figure 11:
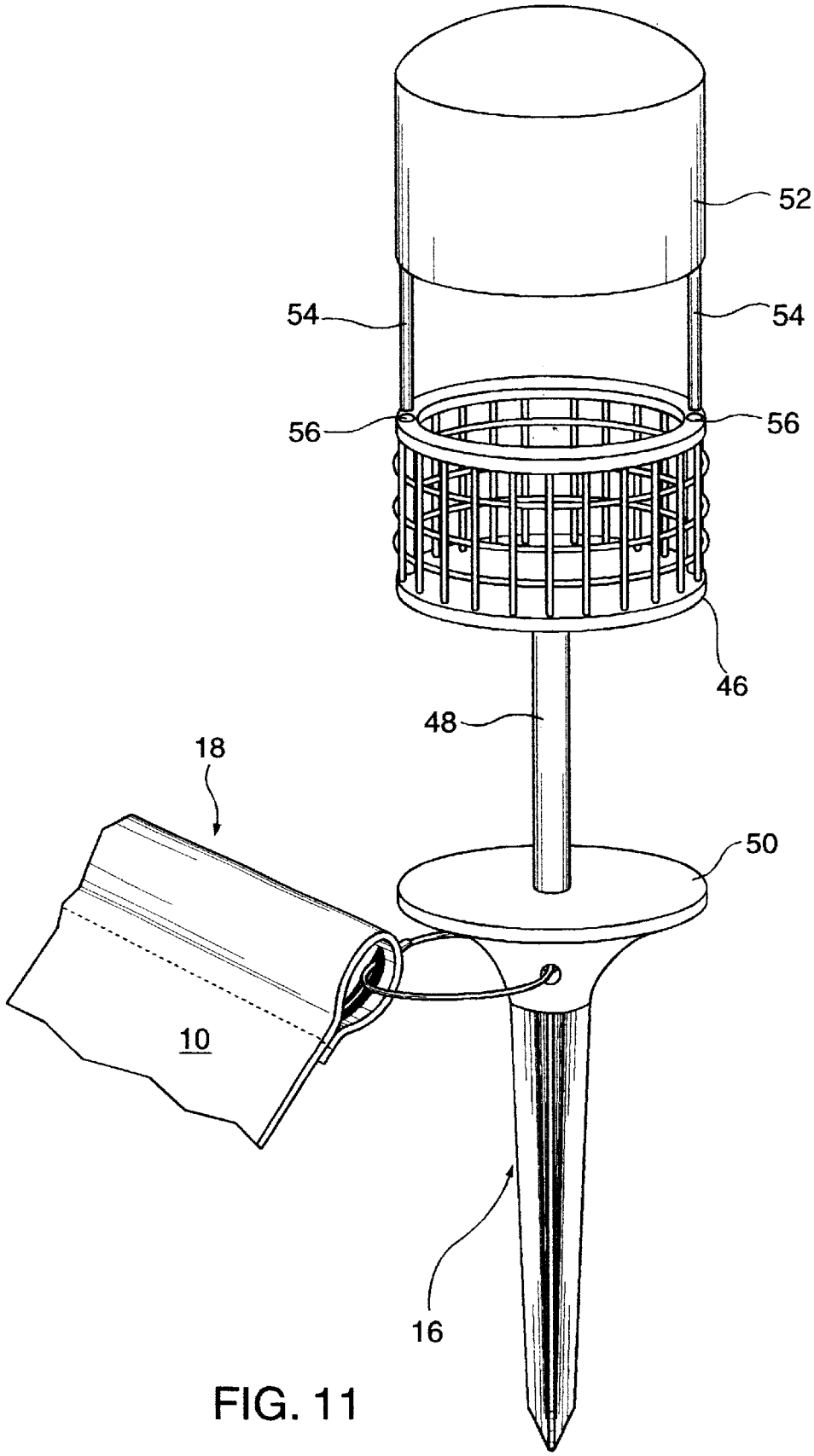
FIG. 11 is a partial perspective view of the cup holder of FIG. 10 in detail.

FIG. 11 shows the cap 52 of the anchor assembly 16 having a flat plate that constitutes a foot plate 50 for driving the anchor assembly 16 into the sand 12. A cup holder may be any suitable height which could accommodate a standard-size 5 inch beverage can and the like. The cap 52 may be a separate unit with two rods 54 that fit into channels 56 on either side of the cup holder 46. This allows the cap to be used with beverage containers or other items up to 10 inches.

Figure 12:
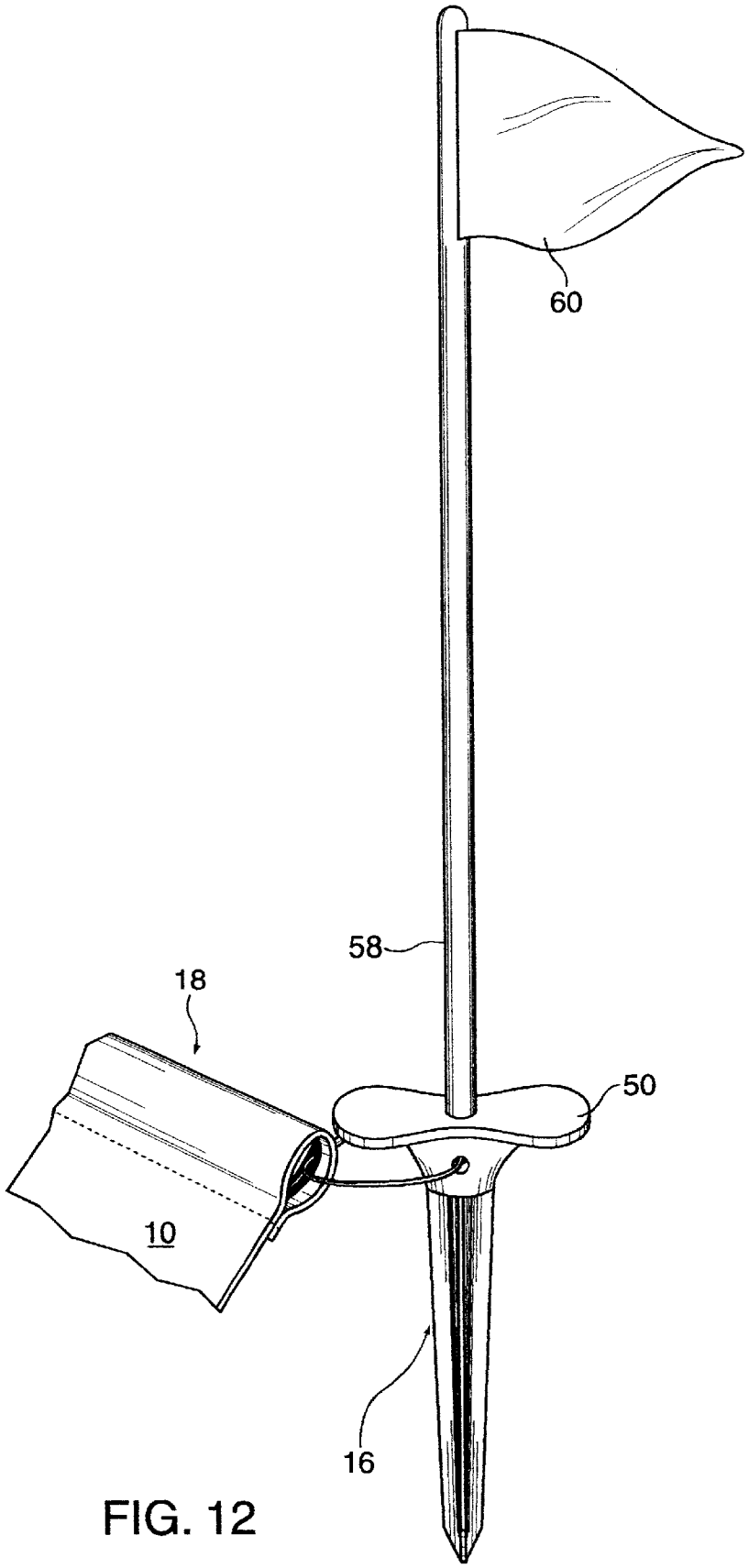
FIG. 12 is a partial perspective view of the flag of FIG. 10 in detail.

FIG. 12 shows the flag 60 also having a flat footplate 50 so that it performs the same function as the one associated with the cup holder 46. A flag may be made in a variety of colors, sizes and designs for attracting the attention of the passers-by. The use of a rigid placard rather than a draping flag shape may also be used. A supporting staff 58 of the flag 60 may be made in any suitable height. A flag provides group affinity or signalling passers-by.

Figure 13:
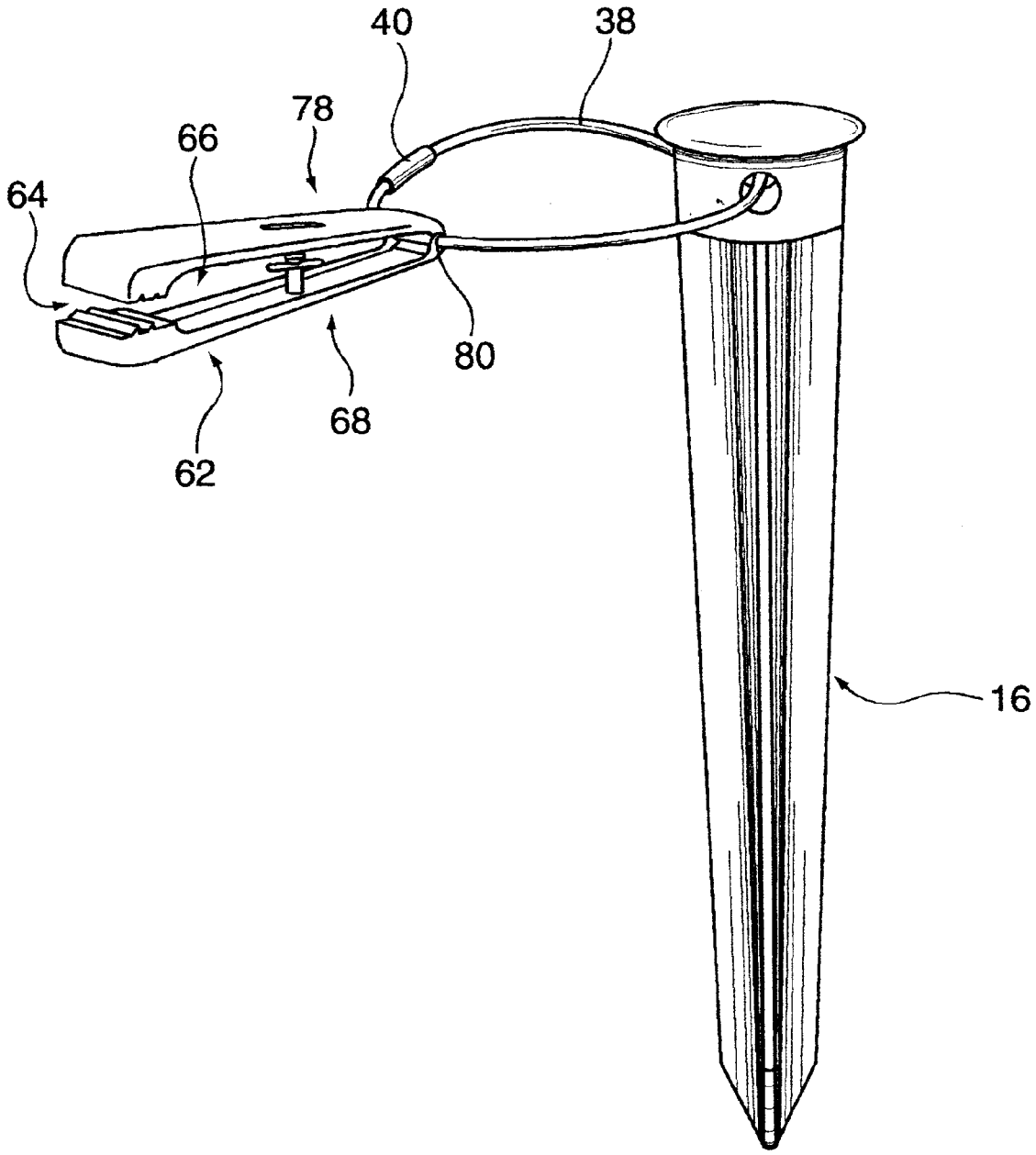
FIG. 13 is a partial perspective view of the clip fastener and anchor assembly of FIG. 10 in detail.

FIG. 13 shows a clip fastener 62 connected to the anchor assembly 16 via the tether 38 with its end-to-end connector 40. The clip fastener 62 is shown as a toggle fastener type. The clip fastener 62 consists of upper and lower plates 68, 78 connected by a hinge 80 which plates are readily latched together to form a firm attachment when the clip fastener 62 operatively clamped on the ground covering 10. The plates may have various types of gripping means and be made of various materials. A concave opening 66 exists within the confines of the plates 68, 78 and the end opening 64 allows the clip fastener 62 to fit securely around the covering 10.

In summary, the present invention provides a kit of various beach products for a user at the beach that involves the use of a ground covering such as a beach blanket. The ground covering includes loops or buttonholes at appropriate sites thereon for receiving the anchors. A hem is constructed on each end of the ground covering and the respective hems are rolled into cylindrical-shaped or sheath-like members for storing kit parts and subsequent transport. The kit may include ground anchor pins operatively secured to the ground covering, which pins are operatively inserted into the sand. Or optionally in lieu of the anchor pins, the kit may include tethered ground anchor assemblies that are operatively inserted into the sand. The kit includes an anchor assembly that is associated with a cup holder for receiving a capped beverage container therein. The kit also includes a flag associated with an anchor assembly for group affinity or signalling passers-by. The kit may include various types of fasteners for securing the respective anchor assembly to the ground covering.

A kit of beach products as defined above may be commercially sold separately or as a packaged unit. Accordingly, the addition or substraction of certain products/parts may be readily made and are considered within the scope of the invention.

While the invention has been particularly shown and described with reference to an embodiment thereof, it will be understood by those skilled in the art that various changes of form and detail may be made without departing from the spirit and scope of the invention.

What is claimed is:

1. A kit of various beach products for use on the ground, consisting of:

a ground covering having hems on the ends thereof;

a plurality of ground anchor assemblies operatively secured to the ground covering and operatively inserted into the ground;

at least one of the anchor assemblies associated with a cup holder product for receiving a capped beverage container therein;

at least another one of the anchor assemblies associated with a flag product for group affinity and/or signalling passers-by;

connecting means operatively associated and selectively with each of the anchor assemblies for connecting the respective anchor assembly to the ground covering;

whereby a kit of such various beach products are useful for the convenience, enjoyment and safety of a user is provided.

2. A kit according to claim 1, wherein the connecting means is a tether which is operatively secured to the ground covering.

3. A kit according to claim 1, wherein each of the anchor assemblies is associated with a fastener for operatively attaching the respective anchor assembly to the ground covering.

4. A kit according to claim 3, wherein the fastener is a toggle fastener.

5. A kit according to claim 1, wherein the ground covering is a beach blanket.

6. A kit according to claims 1, wherein the hems are constructed on each end of the ground covering and the respective hems are rolled into sheaths for storing kit products.

7. A kit according to claims 1 or 6, wherein buttonholes are constructed at appropriate sites on the ground covering for selectively and operatively receiving the connecting means associated with the respective anchor assemblies.

8. A kit according to claim 7, wherein the buttonholes are made on the respective hem.

9. A kit according to claim 1, wherein the connecting means includes a loop attached to the respective hem.

10. A kit according to claim 1, wherein the ground covering has a rectangular shape.

* * * * *